United States Patent [19]

Tuttle

[11] 4,421,163

[45] Dec. 20, 1983

[54] DOWNHOLE STEAM GENERATOR AND TURBOPUMP

[75] Inventor: Gary E. Tuttle, Canoga Park, Calif.

[73] Assignee: Rockwell International Corporation, El Segundo, Calif.

[21] Appl. No.: 282,487

[22] Filed: Jul. 13, 1981

[51] Int. Cl.[3] ..... E21B 43/24

[52] U.S. Cl. ..... 166/59; 166/303

[58] Field of Search ..... 166/59, 302, 303, 257, 166/272, 61, 62, 68, 105, 106, 306

[56] References Cited

U.S. PATENT DOCUMENTS

| | | | |
|---|---|---|---|
| 2,980,184 | 4/1961 | Reed | 166/303 |
| 4,285,401 | 8/1981 | Erickson | 166/303 |
| 4,336,839 | 6/1982 | Wagner et al. | 166/59 |

*Primary Examiner*—James A. Leppink
*Assistant Examiner*—Hoang C. Dang
*Attorney, Agent, or Firm*—H. Fredrick Hamann; Harry B. Field

[57] ABSTRACT

An oil recovery system comprising a downhole steam generator 24, a pump 32 and a turbine 36 operable by said steam generator 24 to drive said pump 32.

2 Claims, 1 Drawing Figure

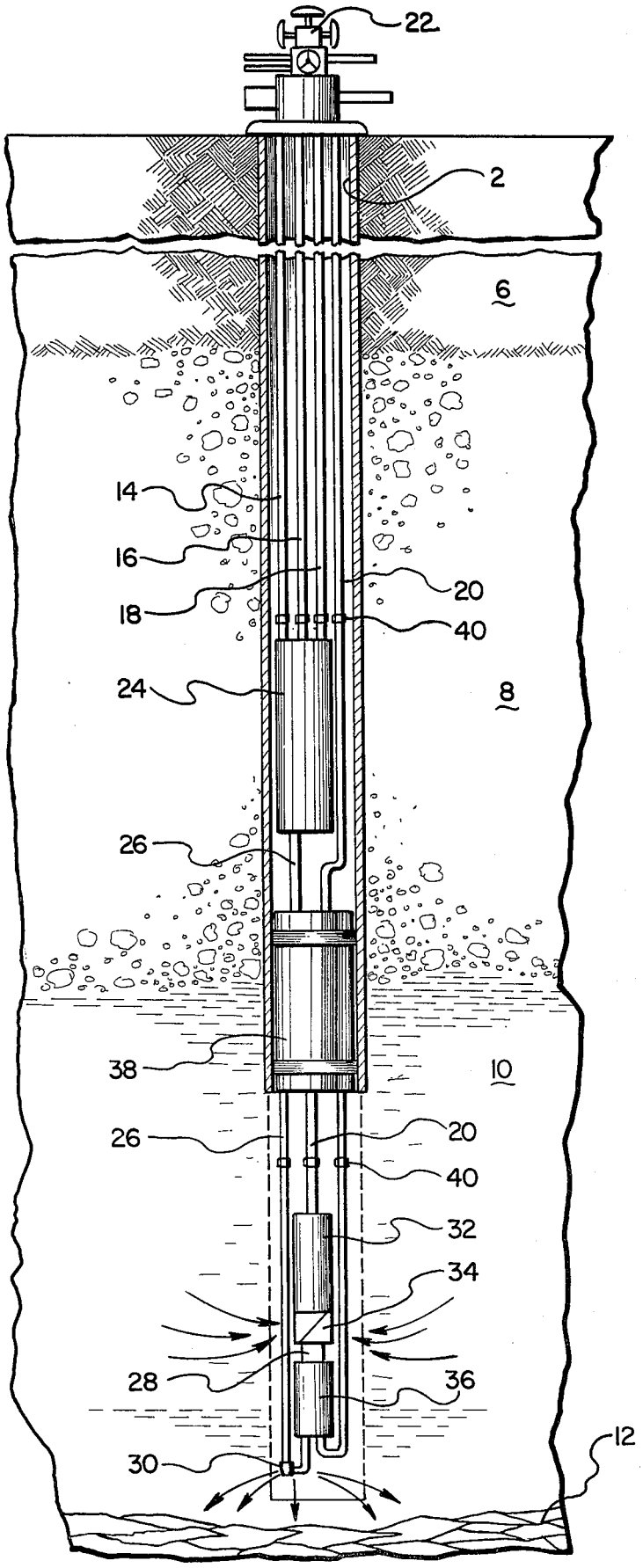
22
2
6
14
16
18
20
40
24
8
26
38
10
26
20
40
32
34
28
36
30
12

DOWNHOLE STEAM GENERATOR AND TURBOPUMP

BACKGROUND OF THE INVENTION

1. Field of the Invention

This invention relates to secondary oil recovery systems and is particularly directed to apparatus for generating steam in a borehole to enhance oil recovery from adjacent formations and to drive a turbopump for delivering the recovered oil to the surface of the earth.

2. Description of the Prior Art

The use of steam for enhancing secondary oil recovery began in the United States around 1960. Originally, the process called for a steam generator located at the surface with the steam being injected into the treated well. Over the next twenty years, steam stimulation has gained wide acceptance and downhole steam generators have been developed, which are lowered into the borehole to generate steam in situ. Typical of these downhole steam generators is that disclosed in the copending application of William R. Wagner et al, Ser. No. 202,990, filed Nov. 3, 1980, assigned to the present assignee.

The Wagner device is a vast improvement over previous steam generators. However, there has still been considerable room for further improvement. With the steam generators of the Wagner type, the generator is lowered down the borehole to the level of the formation to be treated, where it generates steam and injects the steam into the formation. After a desired period of time, the steam generator is withdrawn from the borehole and is replaced by a pump which serves to produce the oil which was released by the steam. Obviously, a substantial period of time is required to accomplish this transfer and the steam-treated formation will be cooling down during this period. Consequently, much of the effect of the steam treatment is wasted. Moreover, the operations involved in lowering the steam generator into the borehole, subsequently removing it, and lowering the pump, require much labor and downtime, which add substantially to the cost of the process.

BRIEF SUMMARY AND OBJECTS OF INVENTION

These disadvantages of the prior art are overcome with the present invention and apparatus is provided which eliminates the losses associated with equipment transfers and which permits steam treatment and production to occur without intermediate equipment transfers and, in fact, permit production to occur simultaneous with the steam treatment. Moreover, the apparatus of the present invention is compact in size and simple to operate and maintain.

The advantages of the present invention are preferably attained by providing a secondary oil recovery system having a downhole steam generator, a pump and a turbine mounted substantially in tandem relation and valve means for diverting at least a portion of the steam developed by said steam generator through said turbine to cause said turbine to drive said pump.

Accordingly, it is an object of the present invention to provide improved apparatus for secondary oil recovery.

Another object of the present invention is to provide improved apparatus for steam treating subterranean formations and recovering oil released from the formations by said treatment.

An additional object of the present invention is to provide improved apparatus for steam treating borehole formations and recovering oil released by the treatment without requiring intermediate transfer of equipment into and out of the borehole.

A further object of the present invention is to provide apparatus for steam treating borehole formations and recovering oil released by said treatment which apparatus is compact in size and simple to operate and maintain.

A specific object of the present invention is to provide a secondary oil recovery system having a downhole steam generator, a pump and turbine mounted substantially in tandem relation, together with valve means for diverting at least a portion of the steam developed by said steam generator through said turbine to cause said turbine to drive said pump.

These and other objects and features of the present invention will be apparent from the following detailed description, taken with reference to the accompanying drawing.

BRIEF DESCRIPTION OF DRAWING

The FIGURE is a diagrammatic representation of secondary oil recovery apparatus embodying the present invention.

DETAILED DESCRIPTION OF THE PREFERRED EMBODIMENTS

In that form of the present invention chosen for purposes of illustration, the FIGURE shows a borehole 2 extending through a plurality of formations, as seen at 6, 8, 10, and 12. The borehole 2 may or may not be cased, as is well known in the art. A plurality of conduits 14, 16, 18, and 20 extend into the borehole 2 from a suitable wellhead valve structure 22. Conduits 14, 16, and 18 are connected to a downhole steam generator 24, which may be of the type disclosed by Wagner et al in the aforementioned patent application, Ser. No. 202,990, and serve, respectively, to supply the steam generator 24 with fuel, air, and water from suitable sources, not shown, adjacent the wellhead valve 22.

Steam developed by the steam generator 24 is supplied through conduit 26, diverter valve 28 and nozzle 30 into the borehole 2 and adjacent formation 10 to release oil from the formation 10, as is well known in the art. An oil pump 32, having an inlet 34, is mounted in tandem with the steam generator 24 and serves to deliver oil to the surface through conduit 20 and wellhead valve 22 to suitable storage means, now shown. A turbine 36 is mounted in tandem with pump 32 and is actuated by steam from steam generator 24, via diverter valve 28, to drive the pump 32. A packer 38 serves to secure the apparatus at a desired location within the borehole 2 and suitable connectors 40 serve to secure the various components to form an integral unit.

In use, fuel, air, and water are supplied, via conduits 14, 16, and 18, to the steam generator 24, which produces steam and supplies it through conduit 26, diverter valve 28, and nozzle 30 to treat the formation 10 adjacent the borehole 2. When desired, diverter valve 28 is actuated to divert part or all of the steam from generator 24 through turbine 36. This serves to drive pump 32, which draws oil through inlet 34 and delivers it through conduit 20 and wellhead valve 22 to suitable storage means at the surface.

Obviously, numerous variations and modifications can be made without departing from the present invention. Accordingly, it should be clearly understood that the form of the present invention described above and shown in the accompanying drawing is illustrative only and is not intended to limit the scope of the invention.

What is claimed and desired to be secured by Letters Patent of the United States is:

1. An oil recovery system comprising:

as borehole leading downward from a wellhead;

a fuel-burning steam generator for generating steam at a desired downhole location within said borehole;

an oil pump mounted adjacent said generator, said pump serving to draw oil and to deliver the oil through an oil conduit to said wellhead;

a steam turbine mounted adjacent said generator and operable to drive said pump;

means for delivering steam from said generator into the formations adjacent said borehole;

diverter valve means operable to supply at least a portion of the steam from said generator to operate said turbine; and packer means for sealing said borehole above said delivering means and for securing the components of said system at a desired location in said borehole.

2. The system of claim 1 wherein said packer means includes a plurality of connector means for securing the components of said system to form an integral unit.

* * * * *